US006155744A

United States Patent [19]

Namanny

[11] Patent Number: 6,155,744

[45] Date of Patent: Dec. 5, 2000

[54] PARKING MANAGEMENT SYSTEM

[76] Inventor: Kenneth D. Namanny, 416 Main St., Cumberland, Iowa 50843

[21] Appl. No.: 09/226,260

[22] Filed: Jan. 7, 1999

[51] Int. Cl.[7] ..... E01C 1/00; E01F 13/00; E01F 15/00; E05D 15/02

[52] U.S. Cl. ..... 404/1; 404/6; 49/42; 49/44; 49/49; 256/1

[58] Field of Search ..... 116/63 R; 256/1, 256/13.1, 16, 26, DIG. 165; D24/50; 404/1, 6, 9; 49/42, 44, 49, 381

[56] References Cited

U.S. PATENT DOCUMENTS

| | | | |
|---|---|---|---|
| 2,795,875 | 6/1957 | Nutter et al. | 49/49 |
| 4,026,069 | 5/1977 | Bohnett | 49/49 |
| 4,101,235 | 7/1978 | Nelson | 404/6 |
| 4,290,230 | 9/1981 | T'Kint De Roodenbeke | 49/49 |
| 4,318,079 | 3/1982 | Dickinson | 340/127 |
| 4,458,447 | 7/1984 | Heise et al. | 49/44 |
| 4,472,908 | 9/1984 | Wanzl et al. | 49/25 |
| 4,641,459 | 2/1987 | Mesa | 49/35 |
| 4,649,597 | 3/1987 | Cacicedo | 16/76 |
| 5,004,997 | 4/1991 | Shisgal et al. | 340/436 |
| 5,146,710 | 9/1992 | Caldwell | 49/35 |
| 5,288,164 | 2/1994 | Nasatka | 404/10 |
| 5,929,787 | 7/1999 | Mee et al. | 340/907 |

*Primary Examiner*—Eileen D. Lillis
*Assistant Examiner*—Gary S. Hartmann

[57] ABSTRACT

A parking lot management system including a plurality of parking space barriers each having a vertical member and an arm having an inboard end rotatably mounted to the vertical member. In use, the arm is adapted for pivoting about a vertical axis at least about 90 degrees. The parking space barriers each include a locking assembly for selectively fixing the arm with respect to the vertical member.

4 Claims, 4 Drawing Sheets

PARKING MANAGEMENT SYSTEM

BACKGROUND OF THE INVENTION

1. Field of the Invention

The present invention relates to parking systems and more particularly pertains to a new parking management system for managing parking in a parking lot for preventing damage to vehicles and generating revenue.

2. Description of the Prior Art

The use of parking systems is known in the prior art. More specifically, parking systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,631,727; U.S. Pat. No. 4,101,235; Pat. No. 4,535,974; U.S. Pat. No. 2,923,421; U.S. Pat. No. 5,500,515; and U.S. Pat. Des. No. 279,460.

In these respects, the parking management system according to the present invention substantially departs from the conventional concepts and designs of the prior art, and in so doing provides an apparatus primarily developed for the purpose of managing parking in a parking lot for preventing damage to vehicles and generating revenue.

SUMMARY OF THE INVENTION

In view of the foregoing disadvantages inherent in the known types of parking systems now present in the prior art, the present invention provides a new parking management system construction wherein the same can be utilized for managing parking in a parking lot for preventing damage to vehicles and generating revenue.

The general purpose of the present invention, which will be described subsequently in greater detail, is to provide a new parking management system apparatus and method which has many of the advantages of the parking systems mentioned heretofore and many novel features that result in a new parking management system which is not anticipated, rendered obvious, suggested, or even implied by any of the prior art parking systems, either alone or in any combination thereof.

To attain this, the present invention generally comprises a fence including a plurality of vertical posts mounted to a parking lot and extending upwardly therefrom. Each of the posts has a pair of vertically spaced horizontal members coupled therebetween. As shown in FIG. 1, the fence defines an elongated rear wall, a pair of side walls, and a front wall defining an enclosed interior with a rectangular configuration. The front wall has a pair of square inset portions defined by a pair of perpendicular inwardly extending walls for affording a pair of handicap spaces. The front wall has an entry opening formed between a first one of the inset portions and a midpoint of the front wall. A divider wall is positioned in perpendicular relationship with the front wall and spaced between the first inset portion and the midpoint of the front wall. As such, a shopping cart passageway and a vehicle entryway are defined. A peripheral wall is coupled to the front wall at the midpoint thereof and extends therefrom in perpendicular relationship therewith for confining the vehicle entryway. Further, a shopping cart subdivider wall is mounted between the divider wall and the first inset portion in parallel relationship therewith. The subdivider wall serves for dividing the shopping cart passageway into a shopping cart storage area and a shopping cart passageway. It should be noted that the rear wall includes an exit opening with a sensor for providing an indication upon an exit of a vehicle therethrough. Mounted along a ground surface of the parking lot at the exit opening is a tire puncture strip. Such strip is adapted for puncturing tires of a vehicle attempting entry via the exit opening. Next provided is a pay station including a module mounted within the vehicle entryway adjacent to the divider wall. Such module of the pay station is adapted for accepting a predetermined amount of money. A barricade arm has an inboard end pivotally coupled to the divider wall for raising upon the acceptance of the predetermined amount of money. When raised, the barricade arm allows the entrance of a vehicle through the vehicle entryway. In the preferred embodiment, the pay station is further adapted to calculate a deference between a number of times the barricade arm raises and a number of vehicles that exit through the exit opening. Upon the difference surpassing a predetermined amount, the module of the pay station provides an indication that the parking lot is full. Finally, a plurality of parking space barriers are mounted to the parking lot along inner sides of the side walls of the fence. Each parking space barrier includes a vertical member with an annular flange coupled to a central extent thereof. Also included is an arm defined by a pair of linear horizontal rods each having an inboard end with a sleeve mounted thereon for rotatably receiving the vertical member. A pair of vertical cross bars are coupled between outboard ends of the horizontal rods and central extends of the horizontal rods. In use, the arm is adapted to be pivoted to a deployed orientation in perpendicular relationship with the side walls of the fence. The arm is further capable of a stored orientation in parallel relationship with the side walls of the fence. As shown in FIG. 4, the parking space barriers each include a first diametrically disposed bore formed in the vertical member. Associated therewith is a second diametrically disposed bore formed in the sleeve of a bottommost one of the horizontal rods of the arm. A pin is included having a first end with a disk-shaped head with a chain connected thereto. Such chain is in turn connected to the vertical member. In use, a second end of the pin may be releasably mounted within the bores for fixedly maintaining the arm in the deployed orientation.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structured, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Pat. and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new parking management system apparatus and method which has many of the advantages of the parking systems mentioned heretofore and many novel features that result in a new parking management system which is not anticipated, rendered obvious, suggested, or even implied by any of the prior art parking systems, either alone or in any combination thereof.

It is another object of the present invention to provide a new parking management system which may be easily and efficiently manufactured and marketed.

It is a further object of the present invention to provide a new parking management system which is of a durable and reliable construction.

An even further object of the present invention is to provide a new parking management system which is susceptible of a low cost of manufacture with regard to both materials and labor, and which accordingly is then susceptible of low prices of sale to the consuming public, thereby making such parking management system economically available to the buying public.

Still yet another object of the present invention is to provide a new parking management system which provides in the apparatuses and methods of the prior art some of the advantages thereof, while simultaneously overcoming some of the disadvantages normally associated therewith.

Still another object of the present invention is to provide a new parking management system for managing parking in a parking lot for preventing damage to vehicles and generating revenue.

Even still another object of the present invention is to provide a new parking management system that includes a plurality of parking space barriers each having a vertical member and an arm having an inboard end rotatably mounted to the vertical member. In use, the arm is adapted for pivoting about a vertical axis at least about 90 degrees. The parking space barriers each include a locking assembly for selectively fixing the arm with respect to the vertical member.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
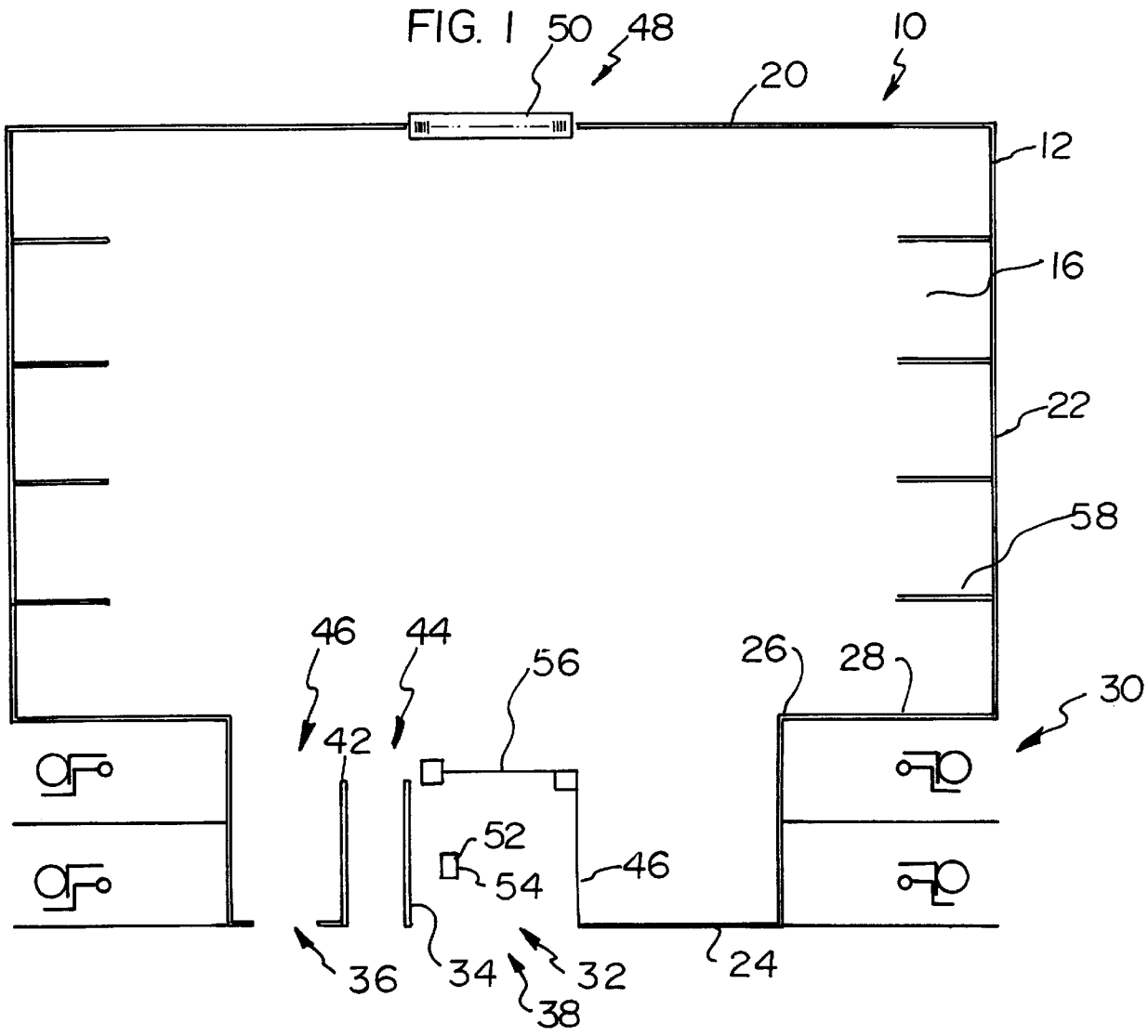
FIG. 1 is a top plan view of a new parking management system according to the present invention.
Figure 2:
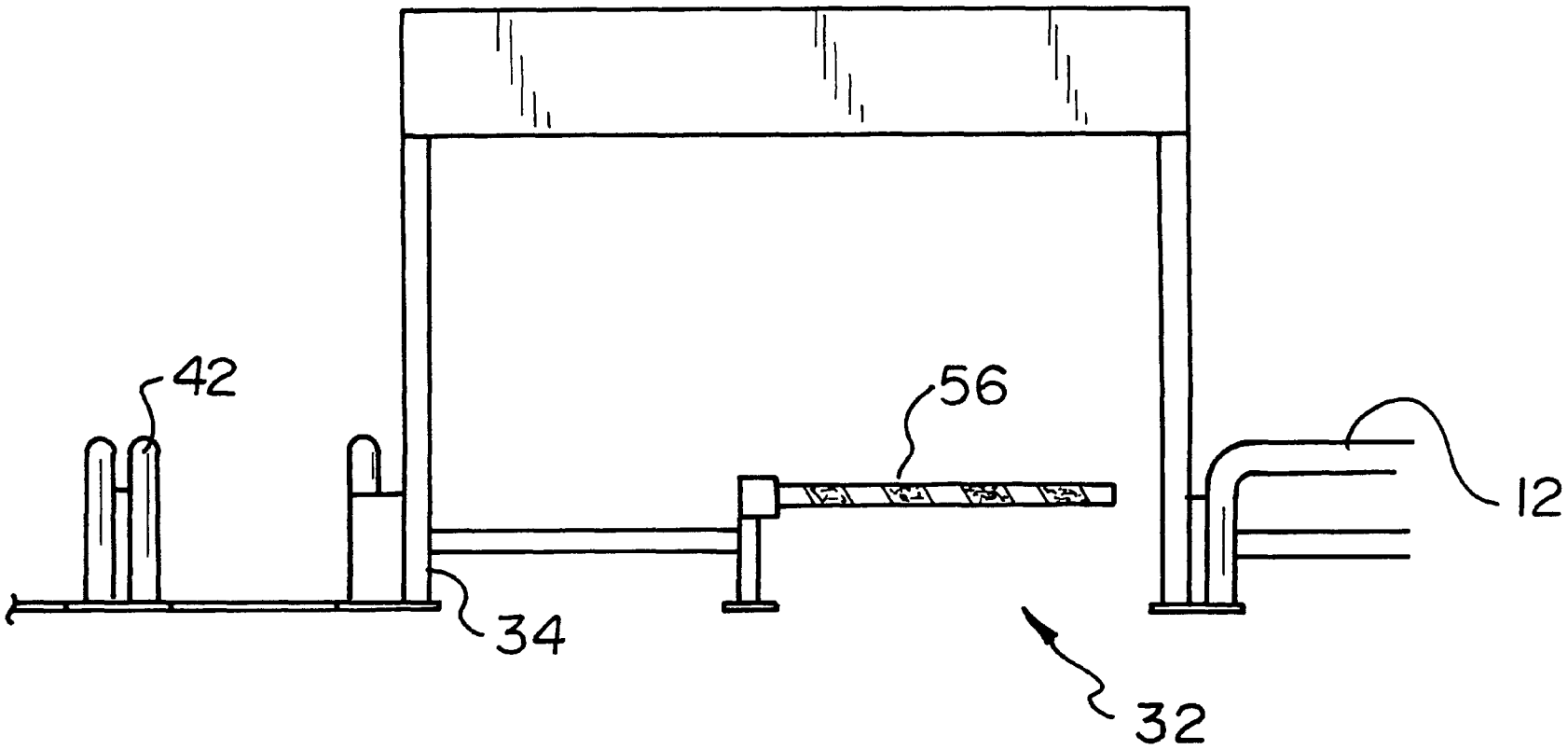
FIG. 2 is a front view of the present invention.
Figure 3:
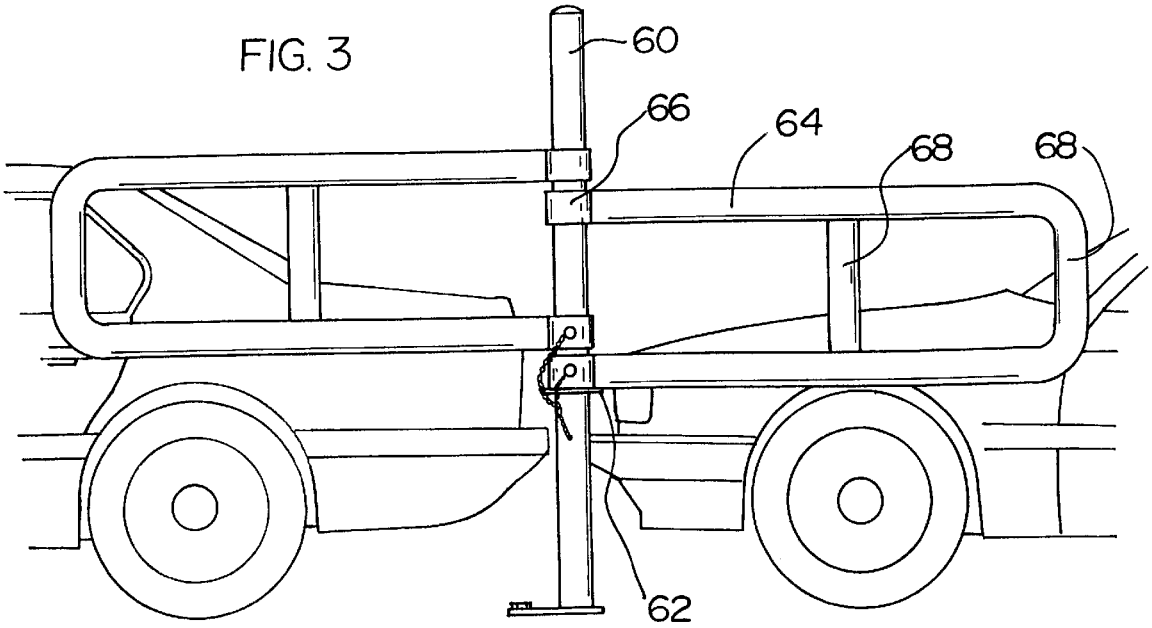
FIG. 3 is a side view of an alternate embodiment of the parking space barriers of the present invention with a pair of arms.

With reference now to the drawings, and in particular to FIGS. 1 through 5 thereof, a new parking management system embodying the principles and concepts of the present invention and generally designated by the reference numeral 10 will be described.

The present invention, designated as numeral 10, includes a fence 12 having a plurality of vertical posts 14 mounted to a parking lot 16 and extending upwardly therefrom. Each of the posts has a pair of vertically spaced horizontal members 18 fixedly coupled therebetween. As shown in FIG. 1, the fence defines an elongated rear wall 20, a pair of side walls 22, and a front wall 24 defining an enclosed interior with a rectangular configuration. The front wall has a pair of square inset portions 26 defined by a pair of perpendicular inwardly extending walls 28 for affording a pair of handicap spaces 30. The front wall has an entry opening 32 formed between a first one of the inset portions and a midpoint of the front wall. Ideally, the entry opening is positioned in close proximity to an associated shopping complex. A divider wall 34 is positioned in perpendicular relationship with the front wall and spaced between the first inset portion and the midpoint of the front wall. As such, a shopping cart passageway 36 and a vehicle entryway 38 are defined.

A peripheral wall 40 is coupled to the front wall at the midpoint thereof and extends therefrom in perpendicular relationship therewith for confining the vehicle entryway. Further, a shopping cart subdivider wall 42 is mounted between the divider wall and the first inset portion in parallel relationship therewith. The subdivider wall serves for dividing the shopping cart passageway into a shopping cart storage area 44 and a shopping cart entryway 46. It should be noted that the rear wall includes an exit opening 48 with an unillustrated sensor or the like for providing an indication upon an exit of a vehicle therethrough.

Mounted along a ground surface of the parking lot at the exit opening is a tire puncture strip 50. Such strip is adapted for puncturing tires of a vehicle attempting entry via the exit opening. It should be noted that the tire puncture strip may take any conventional form which allows the passage of a vehicle thereover in only a single direction.

Next provided is a pay station 52 including a module 54 mounted within the vehicle entryway adjacent to the divider wall. Such module of the pay station is adapted for accepting a predetermined amount of money. A barricade arm 56 has an inboard end pivotally coupled to the divider wall for raising upon the acceptance of the predetermined amount of money. When raised, the barricade arm allows the entrance of a vehicle through the vehicle entryway. In the preferred embodiment, the pay station is further adapted to calculate a difference between a number of times the barricade arm raises and a number of vehicles that exit through the exit opening. Upon the difference surpassing a predetermined amount, the module of the pay station provides an indication in the form of a lighted sign or the like that the parking lot is full.

Finally, a plurality of parking space barriers 58 are mounted to the parking lot along inner sides of the side walls of the fence. Each parking space barrier includes a vertical member 60 with an annular flange 62 coupled to a central extent thereof. Also included is an arm defined by a pair of linear horizontal rods 64 each having an inboard end with a sleeve 66 mounted thereon for rotatably receiving the vertical member. A pair of vertical cross bars 68 are coupled between outboard ends of the horizontal rods and central extents of the horizontal rods. In use, the arm is adapted to be pivoted to a deployed orientation in perpendicular relationship with the side wall of the fence. The arm is further capable of a stored orientation in parallel relationship with the side walls of the fence for allowing snow removal and the like. In the preferred embodiment, the arms have a height of 18 inches. Further, the arm is spaced 4 inches from a top of the vertical member and 18 inches from a bottom of the vertical member.

Figure 4:
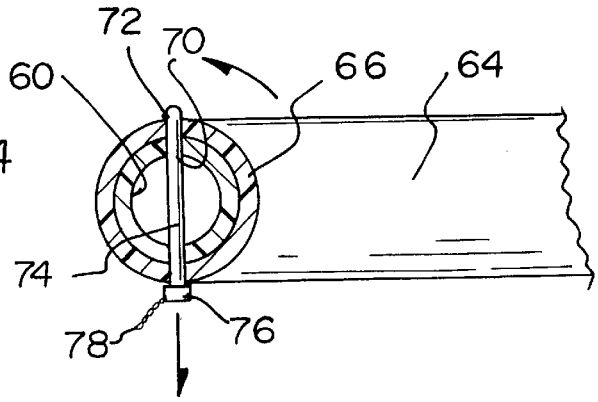
FIG. 4 is a cross-sectional view of one of the parking space barriers of the present invention.
Figure 5:
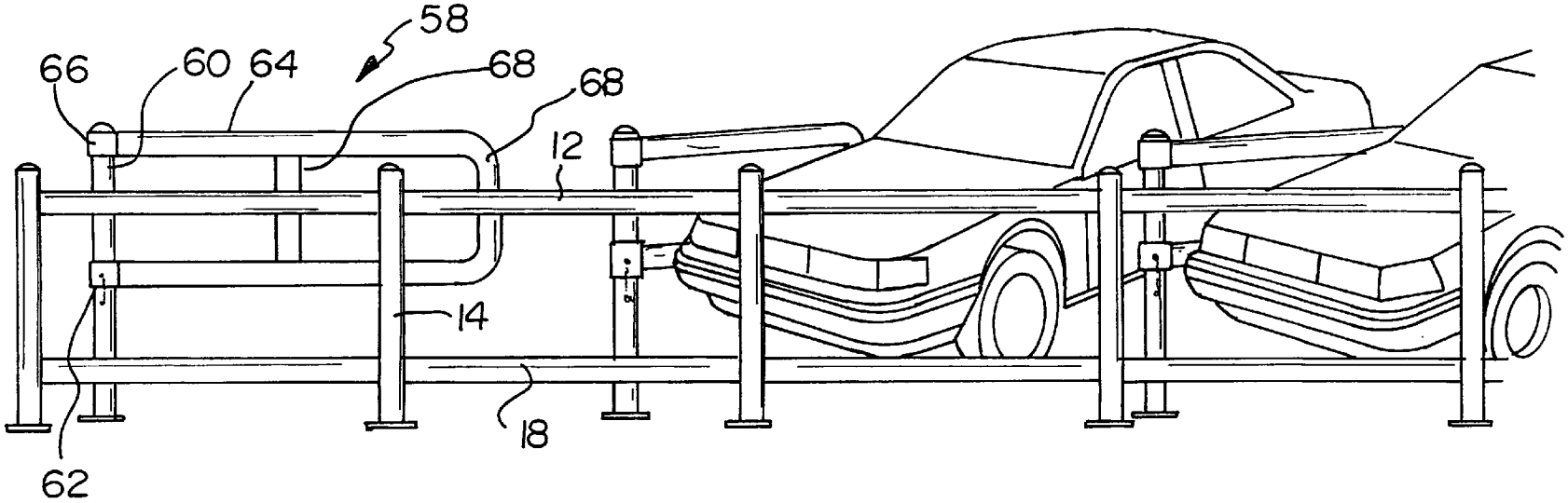
FIG. 5 is a perspective view of the parking space barriers of the present invention.

As shown in FIG. 4, the parking space barriers each include a first diametrically disposed bore 70 formed in the vertical member. Associated therewith is a second diametrically disposed bore 72 formed in the sleeve of a bottommost one of the horizontal rods of the arm. A pin 74 is included having a first end with a disk-shaped head 76 with a chain 78 connected thereto. Such chain is in turn connected to the vertical member. In use, a second end of the pin may be releasably mounted within the bores for fixedly maintaining the arm in the deployed orientation. In the preferred embodiment, the pin is constructed from a plastic or any other malleable material such that the same breaks for allowing the associated arm to pivot upon being struck by a vehicle. As shown in FIG. 1, the parking space barriers define spaces which are smaller than those defined by the inset portions. Ideally, the parking spaces of the inset portions are partitioned by indicia lines.

In an alternate embodiment, each of the parking space barriers may be equipped with a pair of arms which are independently rotatable with respect to the associated vertical member. Further, the parking space barriers may be mounted within parking lot in front of a shopping complex or simply employed to partition a parking lot.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrate in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A parking lot management system comprising, in combination:

a fence including a plurality of vertical posts mounted to a parking lot and extending upwardly therefrom and a pair of vertically spaced horizontal members coupled between each of the vertical posts, the fence defining an elongated rear wall, a pair of side walls, and a front wall defining an enclosed interior with a rectangular configuration, the front wall having a pair of square inset portions defined by a pair of perpendicular inwardly extending walls for affording a pair of handicap spaces, the front wall having an entry opening formed between a first one of the inset portions and a midpoint of the front wall, a divider wall positioned in perpendicular relationship with the front wall and spaced between the first inset portion and the midpoint of the front wall for defining a shopping cart passageway and a vehicle entryway, a peripheral wall coupled to the front wall at the midpoint thereof and extending therefrom in perpendicular relationship therewith for confining the vehicle entryway, and a shopping cart subdivider wall mounted between the divider wall and the first inset portion in parallel relationship therewith for dividing the shopping cart passageway into a shopping cart storage area and shopping cart passageway, wherein the rear wall includes an exit opening with a sensor for indicating an exit of a vehicle therethrough;

a tire puncture strip mounted along a ground surface of the parking lot at the exit opening for puncturing tires of a vehicle attempting entry via the exit opening;

a pay station including a module mounted within the vehicle entry adjacent to the divider wall for accepting a predetermined amount of money and a barricade arm having an inboard end pivotally coupled to the divider wall for raising upon the acceptance of the predetermined amount of money to allow the entrance of a vehicle through the vehicle entryway, wherein the pay station is further adapted to calculate a difference between a number of times the barricade arm raises and a number of vehicles that exit through the exit opening and further providing an indication upon the difference surpassing a predetermined amount, thereby indicating that the parking lot is full; and a plurality of parking space barriers mounted to the parking lot along inner sides of the side walls of the fence and each including a vertical member, an annular flange coupled to a central extent of the vertical member and extending radially outwardly therefrom, and an arm defined by a pair of linear horizontal rods each having an inboard end with a sleeve mounted thereon for rotatably receiving the vertical member and a pair of vertical cross bars coupled between outboard ends of the horizontal rods and central extents thereof, wherein the arm is adapted to be pivoted between a deployed orientation in perpendicular relationship with the side walls of the fence and a stored orientation in parallel relationship with the side walls of the fence;

said parking space barriers each including a first diametrically disposed bore formed in the vertical member, a second diametrically disposed bore formed in the sleeve of a bottommost one of the horizontal rods of the arm, and a pin having a first end with a disk-shaped head including a chain connected thereto which is in turn connected to the vertical member, wherein a second end of the pin may be releasably mounted within the bores for fixedly maintaining the arm in the deployed orientation.

2. A parking lot management system comprising:

a fence including a plurality of vertical posts mounted to a parking lot and extending upwardly therefrom and a pair of vertically spaced horizontal members coupled between each of the vertical posts, the fence defining a rear wall, a pair of side walls, and a front wall defining an enclosed interior, the front wall having an entry opening, a divider wall positioned in substantially perpendicular relationship with the front wall for defining a shopping cart passageway and a vehicle entryway, a peripheral wall coupled to the front wall and extending therefrom for confining the vehicle entryway, and a shopping cart subdivider wall mounted in substantially parallel relationship with the divider wall for dividing the shopping cart passageway into a shopping cart storage area and a shopping cart passageway, wherein the rear wall includes an exit opening with a sensor for indicating an exit of a vehicle therethrough;

a tire puncture strip mounted along a ground surface of the parking lot at the exit opening for puncturing tires of a vehicles attempting entry via the exit opening;

a pay station including a module mounted at the vehicle entryway adjacent to the divider wall for accepting a predetermined amount of money and a barricade arm having an inboard end pivotally coupled to the divider wall for raising upon the acceptance of the predetermined amount of money to allow the entrance of a vehicle through the vehicle entryway, wherein the pay station is further adapted to calculate a difference between a number of times the barricade arm raises and a number of vehicles that exit through the exit opening and further providing an indication upon the difference surpassing a predetermined amount, thereby indicating that the parking lot is full; and a plurality of parking space barriers mounted to the parking lot along inner sides of the side walls of the fence and each including a vertical member, an annular flange coupled to the vertical member and extending radially outwardly therefrom, and an arm defined by a pair of rods each having an inboard end rotatably mounted on the vertical member and a pair of cross bars coupled between the rods, wherein the arm is adapted to be pivoted between a deployed orientation in substantially perpendicular relationship with the side walls of the fence and a stored orientation in substantially parallel relationship with the side walls of the fence;

said parking space barriers each including a first bore formed in the vertical member, a second bore formed in the sleeve of a bottommost one of the horizontal rods of the arm, and a pin having a first end with a disk-shaped head including a chain connected thereto which is in turn connected to the vertical member, wherein a second end of the pin may be releasably mounted in the bores for fixedly maintaining the arm in the deployed orientation.

3. The system of claim 2 wherein the front wall has an inset portion defined by a pair of inwardly extending walls for affording a handicap space outside of the fence.

4. The system of claim 3 wherein the front wall has two inset portions.

* * * * *